US007150080B2

(12) United States Patent
Kaetsu

(10) Patent No.: US 7,150,080 B2
(45) Date of Patent: Dec. 19, 2006

(54) CONCEALED TYPE SLIDE FASTENER

(75) Inventor: Youhei Kaetsu, Kurobe (JP)

(73) Assignee: YKK Corporation, Tokyo (JP)

( * ) Notice: Subject to any disclaimer, the term of this patent is extended or adjusted under 35 U.S.C. 154(b) by 109 days.

(21) Appl. No.: 10/702,383

(22) Filed: Nov. 4, 2003

(65) Prior Publication Data

US 2004/0117952 A1 Jun. 24, 2004

(30) Foreign Application Priority Data

Dec. 20, 2002 (JP) ..... 2002-369312

(51) Int. Cl.
*A44B 1/04* (2006.01)
*A44B 11/25* (2006.01)
*A44B 17/00* (2006.01)

(52) U.S. Cl. ..... 24/436; 24/427; 24/426; 24/415; 24/433; 24/432; 24/405

(58) Field of Classification Search ..... 24/415, 24/426, 427, 433, 436, 405, 432
See application file for complete search history.

(56) References Cited

U.S. PATENT DOCUMENTS

| | | | | |
|---|---|---|---|---|
| 1,910,404 | A * | 5/1933 | Prentice | 24/436 |
| 3,872,551 | A * | 3/1975 | Moertel | 24/388 |
| 3,951,715 | A * | 4/1976 | Hofius | 156/66 |
| 3,969,794 | A * | 7/1976 | Ebata | 24/388 |
| 4,000,546 | A | 1/1977 | Takamatsu et al. | |
| 4,109,349 | A * | 8/1978 | Tanaka | 24/436 |
| 4,223,425 | A * | 9/1980 | Akashi | 24/433 |
| 4,267,621 | A * | 5/1981 | Akashi | 24/396 |
| 4,490,889 | A * | 1/1985 | Yoshida | 24/427 |
| 4,667,377 | A * | 5/1987 | Akashi et al. | 24/436 |
| 5,359,754 | A * | 11/1994 | Kondo et al. | 24/436 |
| 6,530,132 | B1 * | 3/2003 | Yamagishi et al. | 24/427 |
| 6,634,066 | B1 * | 10/2003 | Okada et al. | 24/433 |
| 6,851,162 | B1 * | 2/2005 | Yuki et al. | 24/433 |

FOREIGN PATENT DOCUMENTS

| | | |
|---|---|---|
| DE | 2543375 | 4/1976 |
| DE | 2659395 | 7/1977 |
| GB | 2096693 | 10/1982 |

* cited by examiner

*Primary Examiner*—Robert J. Sandy
*Assistant Examiner*—David Reese
(74) *Attorney, Agent, or Firm*—Everest Intellectual Property Law Group; Michael S. Leonard

(57) ABSTRACT

A concealed type slide fastener comprises two fastener tapes having their opposed edges folded thereon; two rows of fastener elements mounted on the folded edges; a top end stop mounted a fastener element row; and a slider movable along the element rows. The slider 1 has a slider body and a guidepost mounted on the body to define therewith a guide channel through which the element rows run. The guidepost has a sliding surface formed on each side and an overhanging element-guiding portion extending from the upper end of the sliding surface. The concealed type slide fastener further includes means for preventing contact between the element-guiding portion and a corner of the top end stop which faces the element-guiding portion.

8 Claims, 8 Drawing Sheets

CONCEALED TYPE SLIDE FASTENER

CROSS-REFERENCE TO RELATED APPLICATIONS

Not applicable

BACKGROUND OF THE INVENTION

1. Field of the Invention

The present invention relates in general to a concealed type slide fastener comprised of a pair of fastener tapes having two rows of fastener elements mounted on the respective longitudinal folded edges thereof, a top end stop attached to the top end of at least one of the two fastener element rows, and a slider reciprocally movable along the fastener element rows. It particularly relates to relative constructions of a guidepost of the slider and the top end stop made of resin and attached to one end of the longitudinal folded edge of the fastener tape which end stop comes into sliding contact with the guidepost.

2. Description of the Related Art

In such conventional concealed type slide fasteners, fastener elements are mounted on opposed folded longitudinal edges of a pair of fastener tapes. There have been proposed various forms of top stops which are made of resin and welded on the upper ends of the fastener element rows. For examples, there is disclosed in Japanese Utility Model Publication 48-39367 a coiled type slide fastener wherein coiled fastener elements are mounted on folded longitudinal edges of a pair fastener tapes, and a top end stop made of resin and of rectangular cross-section is injection-molded upon an element-free section of the folded longitudinal edge of each fastener tape. FIG. 13 shows a diametrical cross-sectional view of the top end stop 55 attached to the folded longitudinal edge 53 of the fastener tape 51 of the conventional slide fastener.

Most of sliders used for such conventional concealed type slide fasteners are of the type shown in FIG. 12. The concealed type slider 101 has a slider body 103 and a diamond or guidepost 105 mounted at the fore end of, as viewed longitudinally thereof and on the middle of the slider body 103, as viewed laterally thereof. The guidepost 105 is recessed on its opposed sides to thus provide a sliding surface 107 and an overhanging element-guiding portion 109. The element-guiding portion 109 extends outwardly from the top end of the sliding surface 107 for guiding coupling heads of fastener elements, when the fastener element rows runs through the slider 101.

The injection-molded top stop 53 of concealed slide fasteners disclosed in Japanese Utility Model Publication 48-39367 and reproduced here in FIG. 13 of the appended drawings has the following drawback. As the slider 101 is pulled up towards the top end stop 55 in order to fully close the slide fastener, the top end stop 55 tends to be tilted or slanted in the direction indicated by an arrow by lateral tension exerted on the fastener tapes 51 which is combined with presence of side flanges 111 of the slider 101 between the fastener tape 51 and fastener elements. As the top end stops 55 are thus tilted, an upper front corner 57 of the top end stop 55 is forcibly pressed against the horizontal element-guiding portion 109, which renders the upward movement of the slider 101 rather sluggish, thus precluding smooth opening and closing operation of the concealed slide fastener. In worse case, the tilted top end stops 55 could severely impinge against the element-guiding portion 109 of the slider guidepost 105, thus suffering even crucial damages.

In view of the above-mentioned drawback, this invention is designed to improve constructions of a slider and a top end stop of a concealed type slide fasteners. The gist of this invention resides in relative constructions of the guidepost of the slider body and the top end stop attached to the folded longitudinal edge of the fastener tape of the concealed type slide fastener.

An object of the present invention is to provide a concealed type slide fastener, wherein, when a slider is pulled up towards a top end stop to close the slide fastener, an element-guiding portion formed on a guidepost are well prevented from impinging or contacting against the top end stop made of resin attached to a folded edge of the fastener tape so that the top end stop is quite free from damages and thus continues to function in smooth and stable condition for a prolonged period of time.

Further objects and advantages of the present invention will become apparent from a consideration of the drawings and ensuing description.

SUMMARY

In accordance with the present invention, a concealed type slide fastener comprises: a pair of fastener tapes having their respective opposed longitudinal edges folded thereon; two rows of fastener elements mounted on said opposed longitudinal folded edges; a top end stop mounted on the upper end of at least one fastener element row; and a slider 1 reciprocally movable along said fastener element rows, said slider having a slider body and a guidepost mounted on said slider body to define with said slider body a guide channel through which said fastener element rows run, said guide post having a sliding surface formed on each side thereof and an overhanging element-guiding portion extending from the upper end of said sliding surface. The concealed type slide fastener further includes means for preventing contact between said element-guiding portion and a corner of said top end stop which faces said element-guiding portion when said top end stop comes into said guide channel.

DRAWINGS—FIGURES

DRAWINGS—REFERENCE NUMERALS

Figure 1:
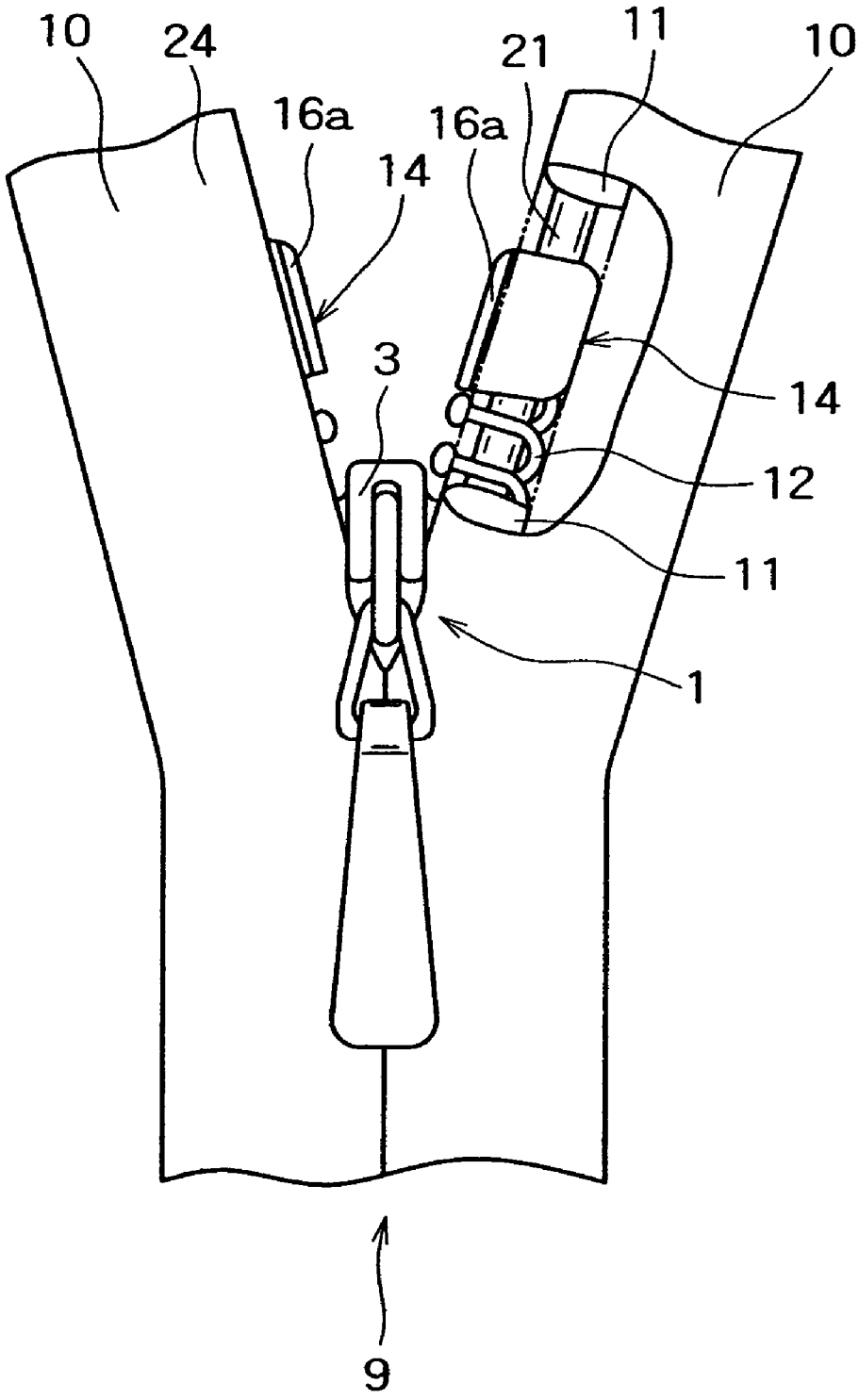
FIG. 1 is a fragmentary front view of a concealed type slide fastener according to the present invention.

1 Slider
3 Guidepost
4 Y-shaped guide channel
5 Side flange
6 Fastener element guiding portion
7 Sliding surface
8 Bevel
10 Fastener tape
11 Longitudinal folded edge portion
12 Fastener element
14 Top end stop
15 Longitudinal corner
16*a* Straight chamfer
16*b* Arcuate chamfer
16*c* Rabbet
16*d* Partial chamfer
16*e* Triangular chamfer
18 Coupling head portion
19 Leg portions
20 Connecting portion
23 Fastener element-row
24 Fastener stringer
25 Space section

DETAILED DESCRIPTION

Description is made below of some embodiments of a concealed type slide fastener according to the present invention in conjunction with drawings appended hereto.

Figure 2:
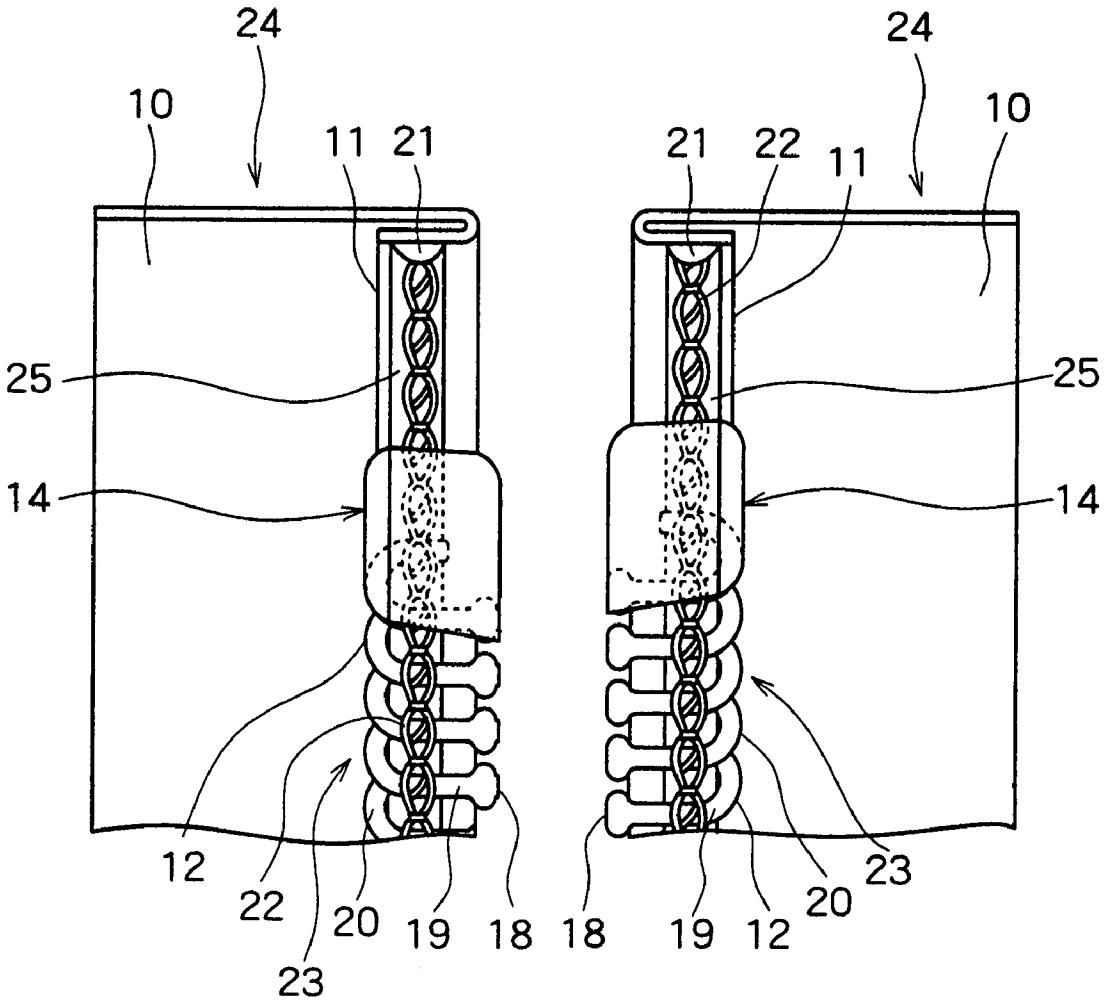
FIG. 2 is a fragmentary rear view of the concealed type slide fastener of FIG. 1.

FIGS. 1 and 2 shows fragmentary front and rear view, respectively, of a concealed type slide fastener according to the present invention. The concealed type slide fastener comprises a pair of slide fastener tapes 10 having their respective longitudinal edges folded thereon like a U-shape, as better shown in FIG. 2, to thus provide confronting folded longitudinal edges 11, and two fastener element rows 23 of continuous filamentary coiled or meander coupling elements 12 which are made of monofilament of plastics such as polyamid, polyester and the like and mounted on the respective folded longitudinal edges 11 of the slide fastener tapes 10.

Each coiled or meander fastener element 12 is comprised of a coupling head portion 18 and a pair of upper and lower leg portions 19 extending in opposite directions from the coupling head portion 18. Each coupling element low 23 has a series of coupling head portions 18 formed longitudinally of the fastener element row 23 and oriented toward the mating fastener element row 23 and series of upper and lower leg portions 19 formed longitudinally of the fastener element row 23 on the opposite sides of the series of coupling head portions 18. Each fastener element row 23 has a filing core 21 inserted between the series of upper and lower leg portions 19 longitudinally of the fastener element row 23. Each fastener element row 23 is secured to the respective longitudinal folded edge 11 of the fastener tape 10 by sewing the leg portions 19 of the fastener element row 23 thereto by means of stitches such as double chain stitches, with the series of coupling heads 18 extending outwardly beyond the longitudinal folded edge 11, to thus provide a fastener stringer 24.

In FIGS. 1 and 2, the reference numeral 20 denotes connection portions extending from each pair of upper and lower leg portions 19 and disposed opposite to the coupling head portions 18. The fastener elements 12 do not need to be continuous or filamentary type fastener elements such as coiled or meander type fastener elements. Instead of continuous type fastener elements, discrete or individual fastener elements may be secured to the longitudinal folded edge portions 11 of the fastener tapes 10.

As better shown in FIG. 2, space sections or element-free sections 25 wherein fastener elements have been removed are formed at predetermined intervals on an elongated fastener stringer 24. An upper end stop 14 is mounted on each space section in such a manner to be contiguous to the upper end of the fastener element row 23. The upper end stop 14 made of thermoplastic resins such as polyacetal, polyamid, polypropirene, polybuchiren teletaphlate etc. is injection-molded integral to the upper end of the fastener element row 23. A pair of fastener stringers 24 are coupled with each other by moving up a slider 1 along the fastener element rows 23, to thus provide a slide fastener chain 9, as better shown in FIG. 1.

Figure 3:
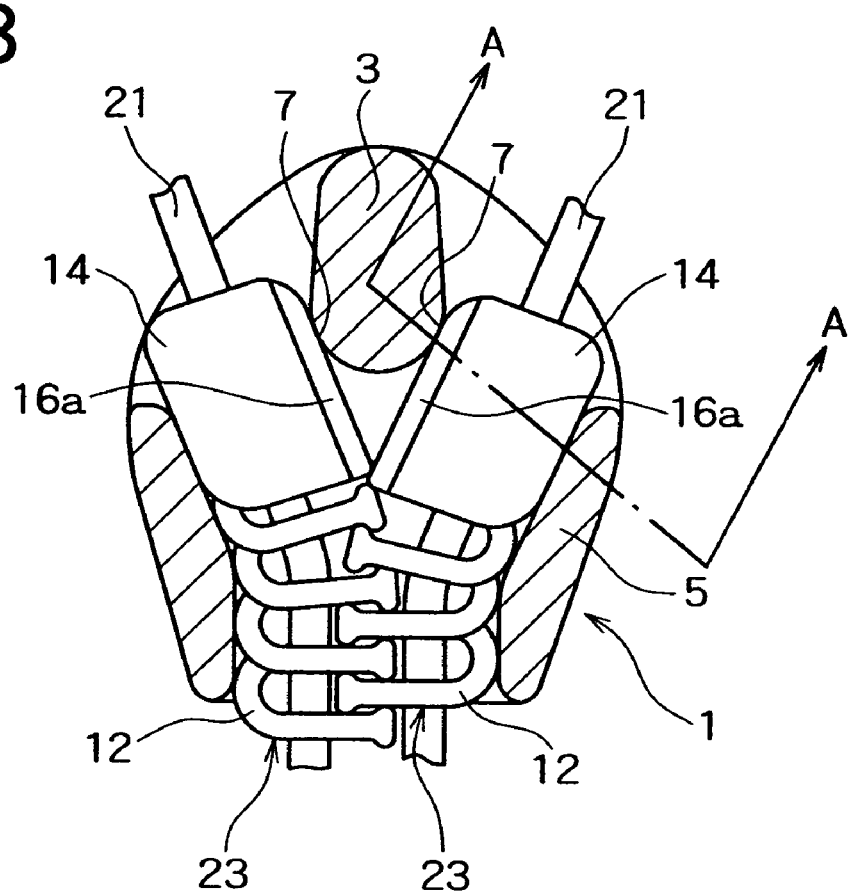
FIG. 3 is a cross-sectional view showing contact-preventing means according to a first embodiment of the present invention.
Figure 4:
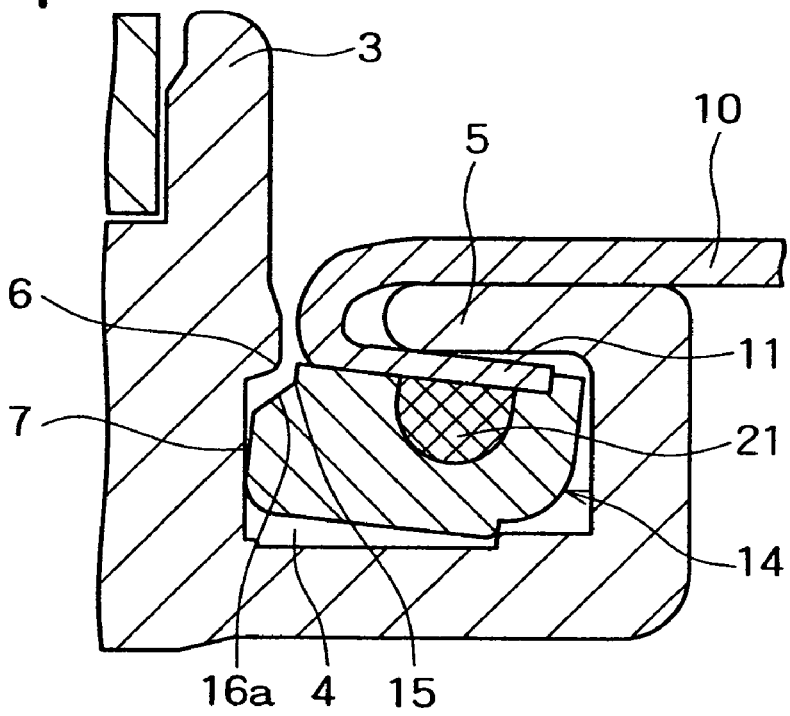
FIG. 4 is a cross-sectional view taken on line A—A of FIG. 3.
Figure 8:
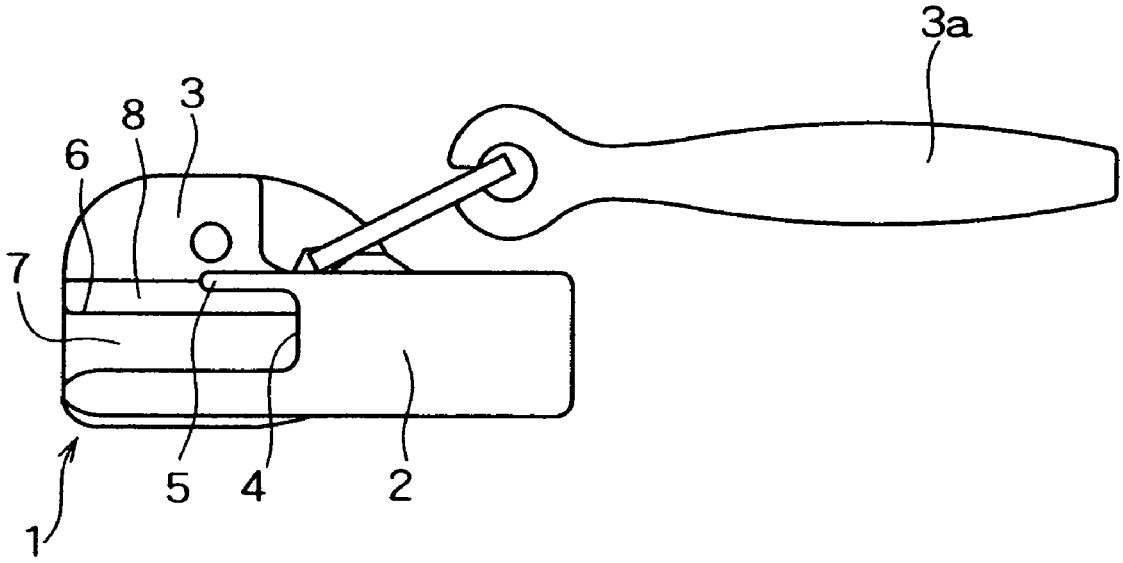
FIG. 8 is a side view of a slider, showing contact-preventing means according to a fifth embodiment.

As shown in FIG. 8, the slider 1 is comprised of a slider body 2, a diamond or guidepost 3 mounted on the middle, as viewed in the lateral direction, and at the fore end, as viewed in the longitudinal direction, of the slider body 2 and a pull tab 3*a* pivotally attached to the upper portion of the guidepost 3. As shown in FIG. 4, the slider body 2 has a pair of channel-shaped side flanges 5 formed one on each side thereof. As shown in FIGS. 3 and 4, the guidepost 3 defines with the channel-shaped side flanges 5 a Y-shaped guide channel 4 through which the fastener element rows 23 run during reciprocation of the slider 1 through the fastener element rows 23. The guidepost 3 has a pair of sliding surfaces 7 formed one on each side thereof. An overhanging element-guiding portion 5 extends outwardly from an upper end of each sliding surface 7. The overhanging element-guiding portion 5 cooperates with the side flange 5 in guiding the fastener element rows 23 as they run through the Y-shaped channel 4.

The characteristic feature of the present invention resides in means for preventing contact between the overhanging element-guiding portion 6 of the guidepost 3 and a relevant longitudinal corner 15 of the top end stop 14. Now, description is specifically made of this characteristic feature in reference to several embodiments in conjunction with the drawings appended hereto.

FIGS. 1 through 4 shows a first embodiment of the present invention. As shown in FIGS. 3 and 4, each top end stop 14 is substantially of the same cross-sectional shape as the fastener element row 23 and is so molded as to extend over a few pitches of fastener elements 12. The top end stop 14 has a groove, specifically, a straight chamfer 16*a* formed on its longitudinal corner 15 which is close to both the coupling head side of the fastener element row 23 and the fastener tape 10, in other words, the longitudinal corner 15 which faces the element-guiding portion 6 of the slider guidepost throughout the full length of the longitudinal corner 15, as better shown in FIG. 4. This is intended to positively prevent the longitudinal corner 15 of the top end stop 14 from coming into contact with the overhanging element-guiding portion 6.

Figure 5:
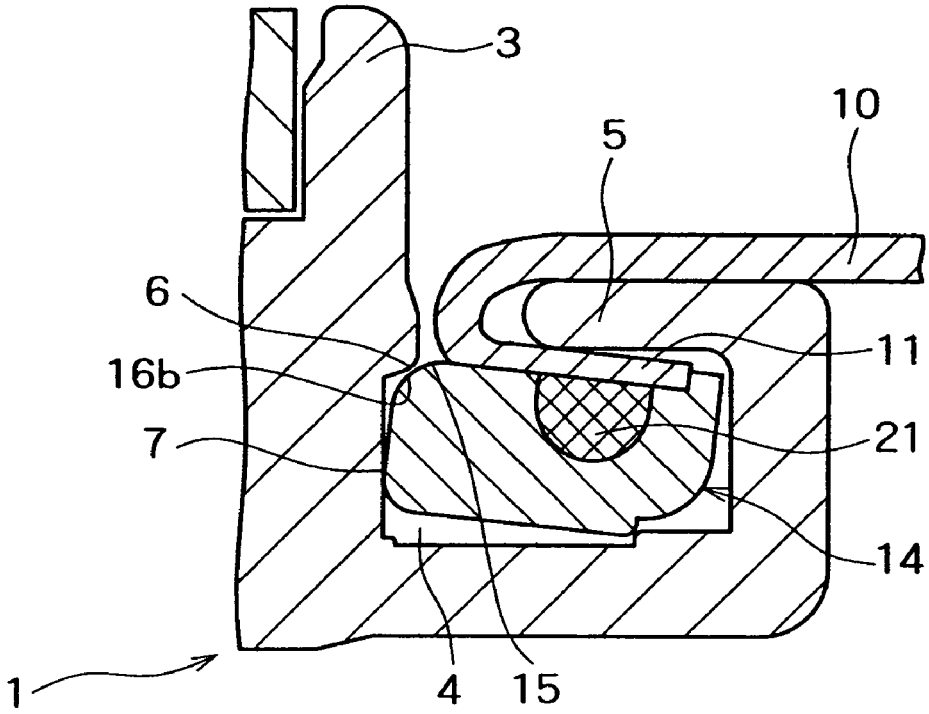
FIG. 5 is a cross-sectional view showing contact-preventing means according to a second embodiment.

FIG. 5 shows a second embodiment of the present invention which is substantially identical to the first modification except that the corner 15 of the top end stop 14 has an arcuate chamfer 16*b*, as a groove, formed on its longitudinal corner 15 which faces the element-guiding portion 6, instead of a straight chamfer 16*a*. This is also intended to positively prevent the corner 15 of the top stop 14 from coming into contact with the element-guiding portion 6.

Figure 6:
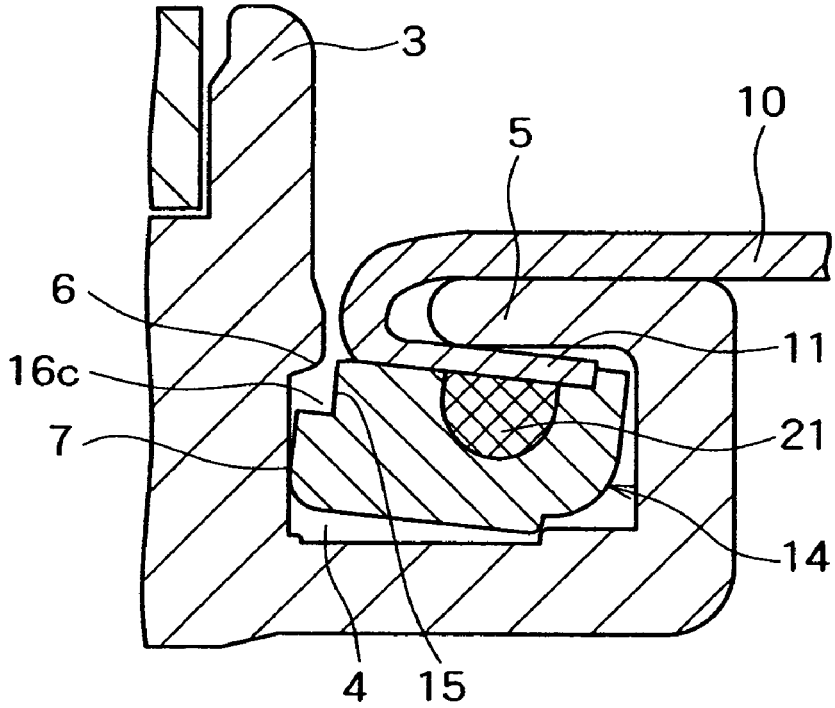
FIG. 6 is a cross-sectional view showing contact-preventing means according to a third embodiment.

FIG. 6 shows a third embodiment of the present invention which is substantially identical to the first and second embodiments except that the top stop 14 has a rabbet 16*c*, as a groove, formed on its corner 15 which faces the element-guiding portion 6 for the above purpose, instead of chamfers 16*a*, 16*b*.

Figure 7:
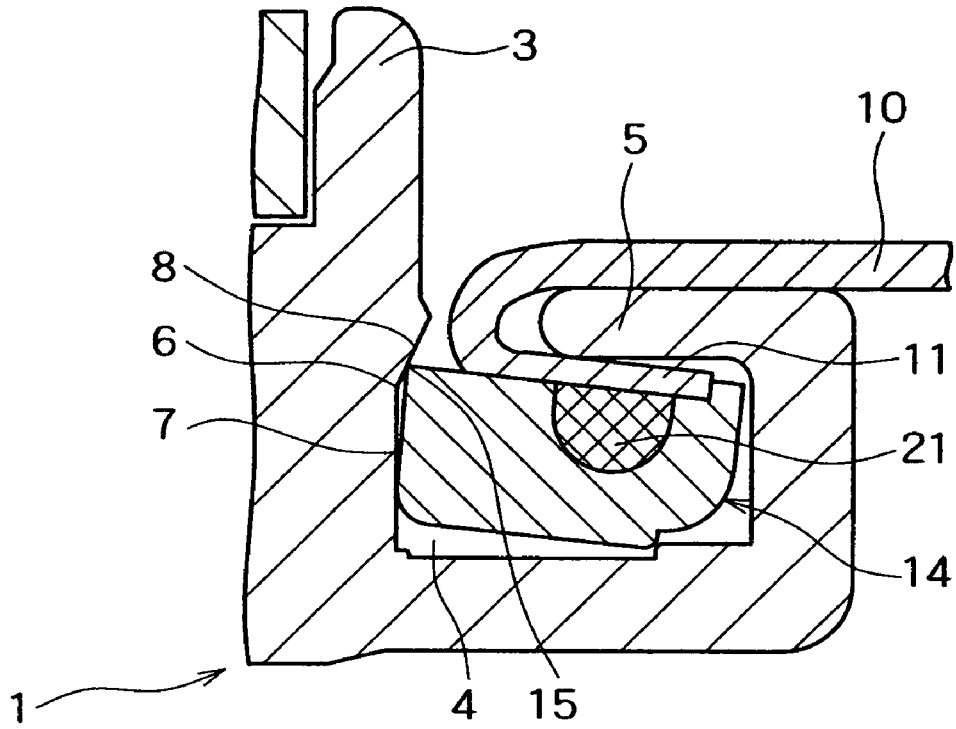
FIG. 7 is a cross-sectional view showing contact-preventing means according to a fourth embodiment.

FIGS. 7 and 8 shows a fourth embodiment of the present invention. In this embodiment, unlike any previous embodiment, there is neither chamfer nor rabbet on the longitudinal corner which faces the element-guiding portion 6. Instead, the overhanging element-guiding portion 6 has a bevel 8 formed thereon. The bevel 8 formed on the overhanging element-guiding portion 6 also functions to positively prevent the corner 15 of the top stop 14 from coming into contact with the element-guiding portion 6.

Figure 9:
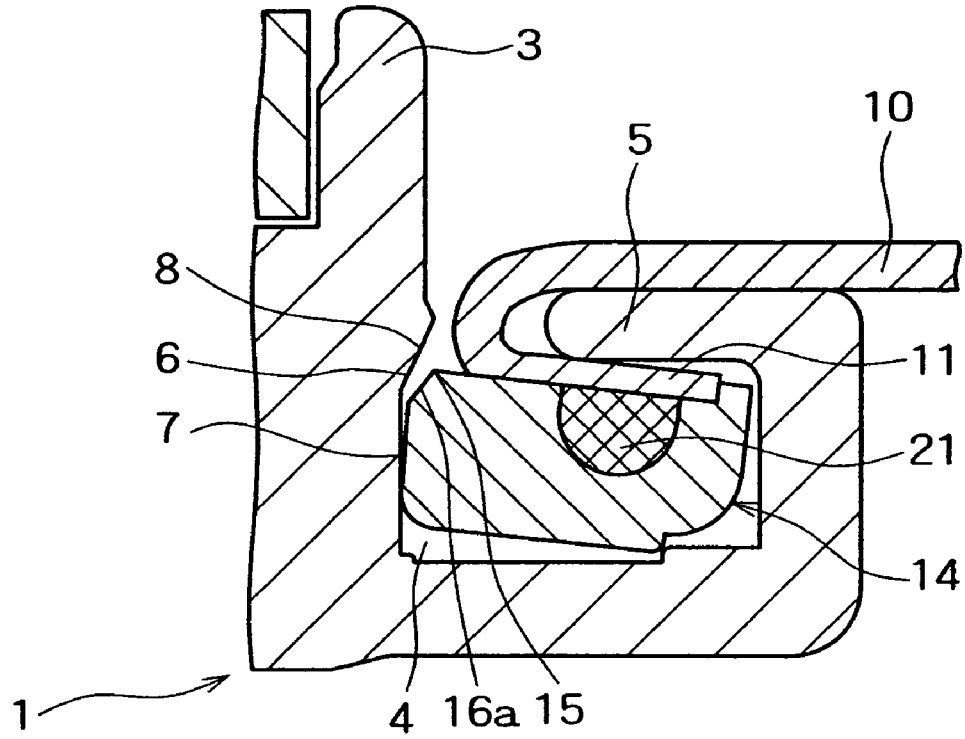
FIG. 9 is a cross-sectional view showing contact-preventing means according to a sixth embodiment.
Figure 10:
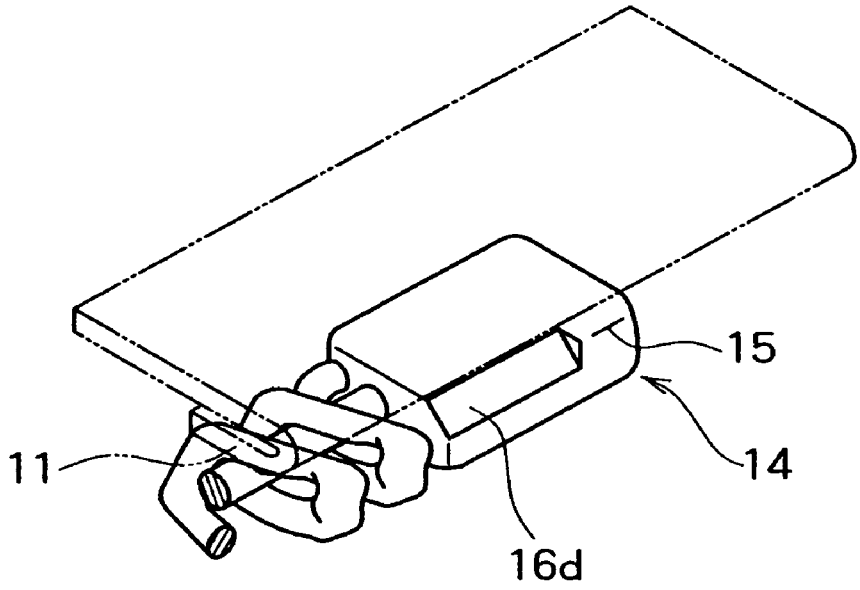
FIG. 10 is a perspective view showing contact-preventing means according to a seventh embodiment.

FIG. 9 shows a fifth embodiment of the present invention. In this embodiment, in order to prevent contact between the top end stop 14 and the element-guiding portion 6, the overhanging element-guiding portion 6 has a bevel 8 formed thereon. In addition to the bevel 8 formed on the element-guiding portion 6, the top end stop 14 has a straight chamfer 16*a* formed on its longitudinal corner 15 which faces the beveled guiding portion 6. In this embodiment, it should be understood that the contact-preventing means 8, 16 are both the bevel 8 formed on the element-guiding portions 6 of the guidepost 3 and the straight chamfer 16*a* formed on the longitudinal corner 15 of the top end stop 14, FIG. 10 shows a sixth embodiment of the present invention, which is substantially identical to the first embodiment with the exception that the chamfer 16*d* is formed not throughout the corer of the top end stop 14 but only partly thereof. This top end stop 14 is suitable for the circumstances where the top end stop 14 itself is so elongated that the chamfer 16*d* does not have to be formed throughout its entire length.

Figure 11:
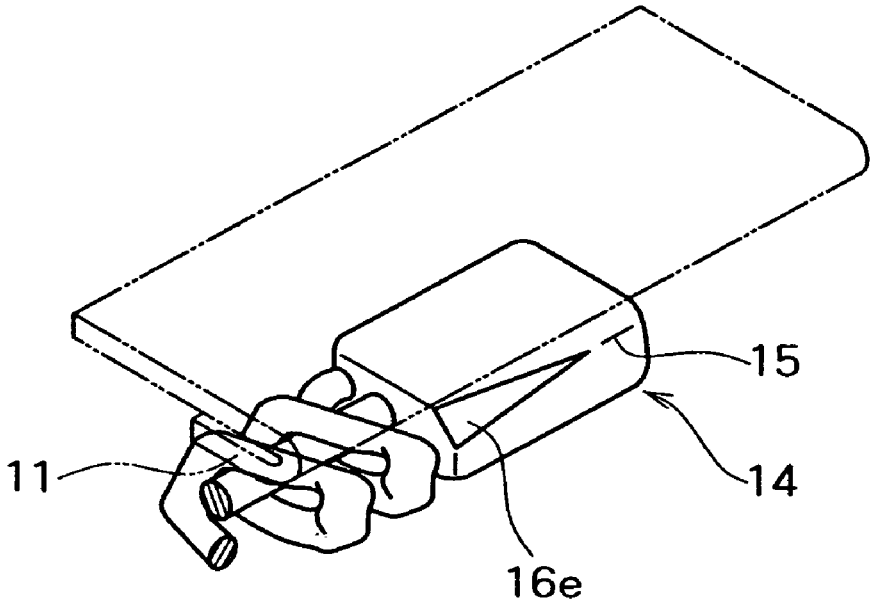
FIG. 11 is a perspective view similar to FIG. 10, but showing contact-preventing means according to a eight embodiment.
Figure 12:
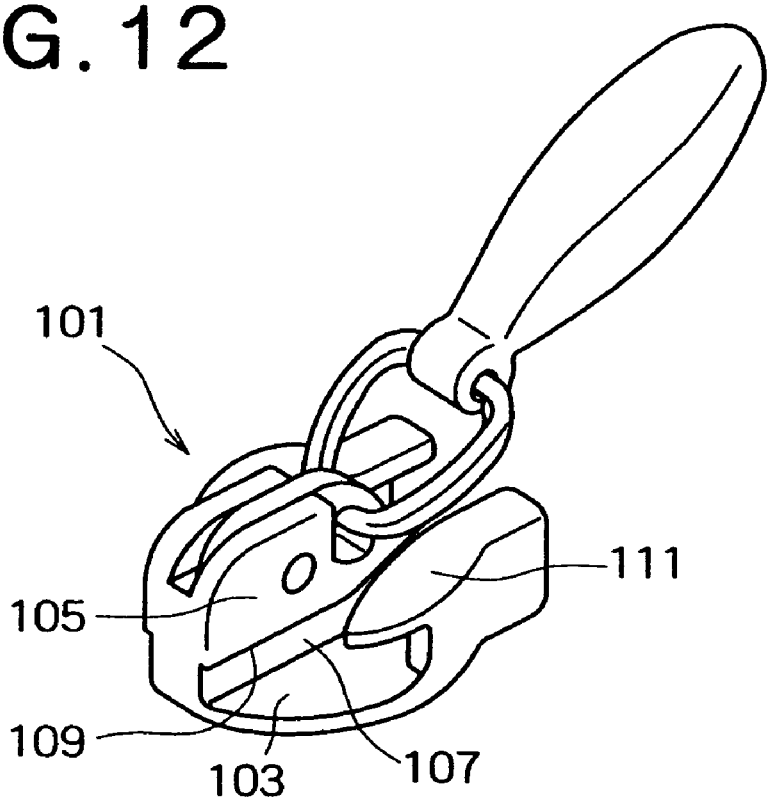
FIG. 12 is a perspective view of a slider for a well-known concealed slide fastener.
Figure 13:
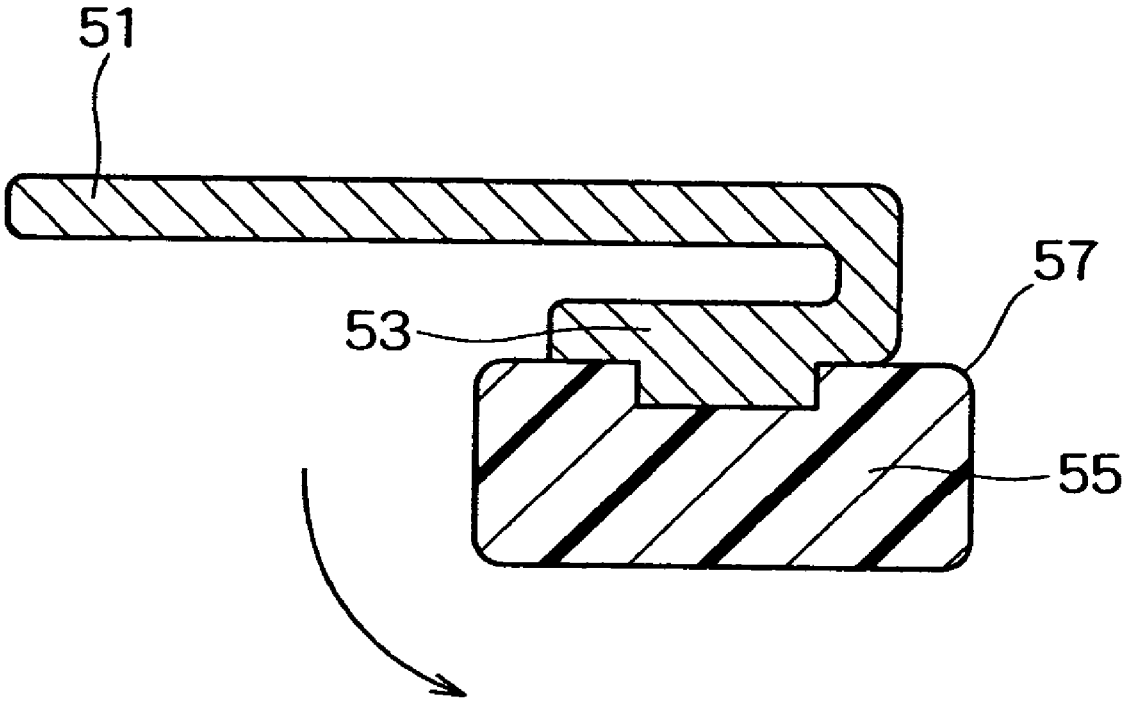
FIG. 13 is a cross-sectional view of a top stop attached to a folded edge of a fastener tape in a well-known concealed slide fastener.

FIG. 11 shows a seventh embodiment of the present invention, which is quite similar to the sixth embodiment shown in FIG. 10. The only difference is that in the seventh embodiment, the chamfer 16*e* formed partly along its one corner is triangular and converges from one end of the top end stop toward the other end, whereas in sixth embodiment, the chamfer 16*d* is rectangular and has a constant width throughout the fill length thereof.

Conclusions, ramifications, and scope:

Thus, the reader will see that, when the slider is pulled up towards the top end stops to close a concealed type slide fastener according to the present invention, the guidepost of the slider is well prevented from impinging or forcibly contact against the top end stops of the slide fastener, so that the top end stop is entirely free from damage, and consequently the concealed type slide fastener continues to be operated in smooth and stable condition.

Furthermore, impinging contacts between the guidepost and the top end stop can easily be avoided simply either by chamfering one corner of the top end stop and/or by forming a bevel on the element-guiding portion of the slider guidepost.

While the above descriptions contain many specificities, these shall not be construed as limitations on the scope of the invention, but rather as exemplifications of embodiments thereof. Many other variations are possible. Accordingly, the scope of the invention should be determined not by the embodiments illustrated, but by the appended claims and the legal equivalents.

What is claimed is:

1. A concealed type slide fastener comprising:

a pair of fastener tapes having their respective opposed longitudinal edges folded thereon so as to have a U-shape;

two rows of fastener elements mounted on said opposed longitudinal folded edges;

a top end stop mounted on the upper end of at least one fastener element row;

a slider reciprocally movable along said fastener element rows, said slider having a slider body, a guidepost mounted on a middle and at a fore end of said slider body and a pair of channel-shaped side flanges formed one on each side thereof to define with said guide post a Y-shaped guide channel through which said fastener element rows run with the side flange disposed between the fastener elements and the tape, said guidepost having a sliding surface formed on each side thereof and an overhanging element-guiding portion extending from the upper end of said sliding surface; and means formed on a corner of said top end stop which faces upward toward a lower corner of said element-guiding portion when said top end stop comes into said guide channel and adapted for preventing contact between said element-guiding portion and said corner of said top end stop.

2. A concealed type slide fastener according to claim 1, wherein said contact-preventing means comprises a groove formed on said corner.

3. A concealed type slide fastener according to claim 1, wherein said contact-preventing means comprises both a groove formed on said corner and a bevel formed on said element-guiding portion.

4. A concealed type slide fastener according to claim 1, wherein said contact-preventing means comprises a groove formed partially on said corner.

5. A concealed type slide fastener according to claim 1, wherein said fastener elements are formed as a filamentary fastener element, said top end stop being molded integrally with said fastener element row and being substantially of the same cross-sectional shape as said fastener elements, the end stop extending over a few pitches of said fastener elements, said contact-preventing means comprising the groove molded on said corner.

6. A concealed type slide fastener according to claim 2, wherein said groove is a straight chamfer formed on said corner.

7. A concealed type slide fastener according to claim 2, wherein said groove is an arcuate chamfer formed on said corner.

8. A concealed type slide fastener according to claim 2, wherein said groove is a rabbet formed on said corner.

* * * * *